US009392642B2

(12) United States Patent
Tanaka et al.

(10) Patent No.: US 9,392,642 B2
(45) Date of Patent: Jul. 12, 2016

(54) IMAGE HEATING APPARATUS

(71) Applicant: CANON KABUSHIKI KAISHA, Tokyo (JP)

(72) Inventors: Masanobu Tanaka, Tokyo (JP); Oki Kitagawa, Kashiwa (JP); Shigeaki Takada, Abiko (JP); Akiyoshi Shinagawa, Kashiwa (JP); Hiroki Kawai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 568 days.

(21) Appl. No.: 13/728,010

(22) Filed: Dec. 27, 2012

(65) Prior Publication Data

US 2013/0206745 A1 Aug. 15, 2013

(30) Foreign Application Priority Data

Feb. 14, 2012 (JP) ..... 2012-029192

(51) Int. Cl.
*B21B 27/06* (2006.01)
*H05B 3/02* (2006.01)
(Continued)

(52) U.S. Cl.
CPC ..... *H05B 1/00* (2013.01); *H05B 1/0241* (2013.01); *G03G 15/2064* (2013.01); *G03G 15/2075* (2013.01); *G03G 15/2078* (2013.01); *H05B 3/0095* (2013.01)

(58) Field of Classification Search
CPC .... H05B 3/00; H05B 3/0095; G03G 15/2064; G03G 15/2078; G03G 15/2085; G03G 15/2053; G03G 15/2089; G03G 15/2067; G03G 21/0011; G03G 15/2075; B29C 65/22
USPC ..... 219/200, 216, 243, 469, 470; 399/67, 399/69, 322, 328, 329, 333, 70, 71, 330, 399/331, 332, 327
See application file for complete search history.

(56) References Cited

U.S. PATENT DOCUMENTS 7,430,392 B2 * 9/2008 Ito et al. ..... 399/328
7,650,105 B2 1/2010 Ogawa et al.
(Continued)

FOREIGN PATENT DOCUMENTS

JP 2000-267491 A 9/2000
JP 2002-202683 A 7/2002
(Continued)

OTHER PUBLICATIONS

Japanese Office Action issued in counterpart Japanese Patent Application No. 2012-029192, dated Dec. 1, 2015.
(Continued)

*Primary Examiner* — Dana Ross
*Assistant Examiner* — Hemant Mathew
(74) *Attorney, Agent, or Firm* — Fitzpatrick, Cella, Harper & Scinto

(57) ABSTRACT

An image heating apparatus includes: an image heating roller in a nip; a nip forming member; a heating roller rubbing roller; a moving mechanism for moving the rubbing roller between a spaced position and a rubbing position; and a controller for executing operations in first and second modes. In the first mode, the heating roller is rotated with the rubbing roller in the spaced position and the heating roller in contact with the nip forming member with a target temperature of the heating roller higher than that of the nip forming member. In the second mode, the rubbing roller is contacted with the heating roller, rubbing the surface of the heating roller. The temperature difference in the first mode between the target temperature of the heating roller and that of the nip forming member is larger than the temperature difference when the toner image is heated by the nip.

6 Claims, 6 Drawing Sheets

(51) Int. Cl.

| | |
|---|---|
| ***H05B 1/00*** | (2006.01) |
| ***H05B 3/00*** | (2006.01) |
| ***H05B 11/00*** | (2006.01) |
| ***G03G 15/20*** | (2006.01) |
| ***H05B 1/02*** | (2006.01) |

(56) References Cited

U.S. PATENT DOCUMENTS

| | | | | |
|---|---|---|---|---|
| 8,145,086 | B2 * | 3/2012 | Chiyoda et al. | 399/67 |
| 8,208,833 | B2 | 6/2012 | Kitagawa | |
| 8,306,446 | B2 * | 11/2012 | Ito | G03G 15/2039 399/329 |
| 8,364,067 | B2 | 1/2013 | Miki et al. | |
| 2002/0048471 | A1 * | 4/2002 | Ishizuka | G03G 15/2064 399/325 |
| 2003/0210936 | A1 * | 11/2003 | Matsumoto | G03G 15/2064 399/327 |
| 2003/0223790 | A1 * | 12/2003 | Kawamoto et al. | 399/327 |
| 2005/0185978 | A1 * | 8/2005 | Kemmochi | 399/69 |
| 2006/0062609 | A1 * | 3/2006 | Kinouchi et al. | 399/328 |
| 2006/0088328 | A1 * | 4/2006 | Yoshimura et al. | 399/69 |
| 2007/0059009 | A1 * | 3/2007 | Nakayama | 399/69 |
| 2008/0038026 | A1 * | 2/2008 | Ai et al. | 399/328 |
| 2008/0038027 | A1 | 2/2008 | Ito et al. | |
| 2009/0196637 | A1 * | 8/2009 | Inomata | 399/44 |
| 2009/0297233 | A1 * | 12/2009 | Kameda | 399/322 |
| 2010/0284713 | A1 * | 11/2010 | Li et al. | 399/328 |
| 2011/0236084 | A1 * | 9/2011 | Nishida et al. | 399/328 |
| 2011/0305474 | A1 | 12/2011 | Tanaka et al. | |
| 2012/0027444 | A1 | 2/2012 | Kitagawa | |
| 2012/0099882 | A1 | 4/2012 | Tanaka | |
| 2012/0155938 | A1 | 6/2012 | Tanaka et al. | |
| 2012/0308279 | A1 | 12/2012 | Tanaka et al. | |
| 2013/0034361 | A1 | 2/2013 | Shinagawa | |
| 2013/0034362 | A1 | 2/2013 | Matsuura et al. | |
| 2013/0051831 | A1 | 2/2013 | Shinagawa et al. | |
| 2013/0058672 | A1 | 3/2013 | Takada et al. | |

FOREIGN PATENT DOCUMENTS

| | | | |
|---|---|---|---|
| JP | 2003-029563 | A | 1/2003 |
| JP | 2003-140504 | A | 5/2003 |
| JP | 2006251591 | A | 9/2006 |
| JP | 2006-317881 | A | 11/2006 |
| JP | 2007199596 | A | 8/2007 |
| JP | 2008-040363 | A | 2/2008 |
| JP | 2008-040365 | A | 2/2008 |
| JP | 2008-129138 | A | 6/2008 |
| JP | 2009-037078 | A | 2/2009 |
| JP | 2010-249885 | A | 11/2010 |
| JP | 2011-081136 | A | 4/2011 |

OTHER PUBLICATIONS

U.S. Appl. No. 13/677,826, filed Nov. 15, 2012, Oki Kitagawa, Shigeaki Takada, Akiyoshi Shinagawa, Masanobu Tanaka.

U.S. Appl. No. 13/602,944, filed Sep. 4, 2012. Oki Kitagawa, Shigeaki Takada, Akiyoshi Shinagawa, Hiroki Kawai.

* cited by examiner (a)

(b)

IMAGE HEATING APPARATUS

FIELD OF THE INVENTION AND RELATED ART

The present invention relates to an image heating apparatus which has a rotational heating member and a nip forming member and heats a toner image on recording medium, in the nip between the rotational heating member and nip forming member. In particular, it relates to an image heating apparatus having a member for buffing the rotational heating member, in addition to the rotational heating member and nip forming member. The image heating apparatus is employed by an electrophotographic image forming apparatus such as a copying machine, a printer, a facsimile machine, a multifunction image forming apparatus capable of functioning as two or more of the preceding machines and apparatuses, etc.

It is a common practice in the field of an electrophotographic image forming apparatus to subject a toner image formed on a recording medium to heat and pressure in the nip between the rotational heating member and nip forming member of an image heating device.

Some types of recording media, for example, some sheets of recording paper, have burrs, that is, microscopic jagged projections, along their edges. Thus, it is possible that when they are conveyed through the nip of an image heating apparatus (device), they will microscopically scratch the rotational heating member of the image heating device, with the burrs which their edges have. Thus, in a case where a large number of sheets of recoding medium, which are the same in size, are continuously conveyed through an image heating apparatus (device), the portions of the rotational heating member of the image heating apparatus, which coincide in position with the lateral edges of a sheet of a recording medium, in terms of the direction perpendicular to the direction in which a recording medium is conveyed through the image heating device, repeatedly encounter with the lateral edges of a large number of sheets of a recording paper. Therefore, it is possible that they will be microscopically scratched by the burrs. Once the rotational heating member of the image heating device of an electrophotographic image forming apparatus is scratched, it is possible for the image heating apparatus (image forming apparatus) to output images which are non-uniform in gloss in terms of the widthwise direction of the recording medium path.

Thus, various methods for dealing with the scratches of the image heating member of an image heating device (apparatus) have been proposed, for example, those disclosed in Japanese Laid-open Patent Applications 2008-40363 and 2008-40365. These methods buff a rotational heating member with a rotational buffing member. As a rotational heating member is uniformly buffed across its entire heating range, by a rotational buffing member, the microscopic scratches which were formed by the microscopic burrs of the lateral edges of a sheet of a recording medium, and the position of which corresponds to the lateral edges of the recording medium path in a heating device, become inconspicuous to the naked eye. It is desired that when the rotational buffing member is not in operation, it is kept separated from the rotational heating member.

However, these methods are problematic in that it is possible that when the rotational heating member is buffed by the rotational buffing member, the toner particles on the rotational heating member will transfer onto the rotational buffing member, and fill up the microscopic recesses in the peripheral surface of the rotational buffing member, reducing thereby the performance of the rotational buffing member. Therefore, it is desirable that the amount of toner on the rotational heating member be reduced before the rotational buffing member is placed in contact with the rotational heating member.

SUMMARY OF THE INVENTION

The present invention makes the toner on the rotational heating member of an image heating device (apparatus) transfer onto the nip forming member of the image heating device before the rotational heating member is buffed by the rotational buffing member. Therefore, it can prevent the toner on the rotational heating member from transferring onto the rotational buffing member.

According to an aspect of the present invention, there is provided an image heating apparatus comprising: a heating rotatable member for heating a toner image on a recording material, in a nip; a nip forming member cooperating with the heating rotatable member to form the nip; a rubbing rotatable member for rubbing a surface of the heating rotatable member; a moving mechanism for moving the rubbing rotatable member between a position spaced from the heating rotatable member and a position for rubbing the heating rotatable member; and a controller for executing, when the recording material is not passing through the nip, an operation in a first mode operation and continuously therewith an a operation in a second mode. In the first mode, the heating rotatable member is rotated at least through one full-turn in a state that the rubbing rotatable member is in the spaced position and that the heating rotatable member is in contact with the nip forming member with a target temperature of the heating rotatable member higher than a target temperature of the nip forming member, and in the second mode, the rubbing rotatable member is contacted with the heating rotatable member by the moving mechanism and rubs the surface of the heating rotatable member. The controller causes a temperature difference in the first mode between the target temperature of the heating rotatable member and a target temperature of the nip forming member to be larger than the temperature difference when the toner image is heated by the nip.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, some of the embodiments of the present invention are described in detail with reference to the appended drawings. The present invention is applicable to any image heating device (apparatus), such as a fixing device, which employs a rotational heating member, a rotational pressure applying member, and a buffing means, as long as the image heating device is structured to remove the toner on the peripheral surface of the rotational heating member with the use of the buffing means, by way of the rotational pressure applying member. That is, the present invention is also applicable to an image heating device which is partially, or in entirety, different in structure, and/or structural components, from those in the following embodiments of the present invention.

In other words, the present invention is compatible with any image forming apparatus that fixes a toner image to a recording medium by applying heat and pressure to the recording medium after the transfer of the toner image onto the recording medium, regardless of image forming apparatus type, that is, whether the image forming apparatus is of the black-and-white or full-color image type, uses cut a recording medium or a roll recording medium, directly or indirectly transfer an image onto a recording medium, how a toner image is formed, how a toner image is transferred, or the like criteria. An "image heating apparatus" includes a surface heating device (apparatus) for modifying an image in surface properties such as gloss, in addition to a fixing device. Not only is an image heating apparatus employed as an integral part of an image forming apparatus, but also, can be used as an independent apparatus. Further, it can be structured as a unit which can be removably installable in the main assembly of an image forming apparatus.

In the description of the following embodiments of the present invention, only the portions of the image forming apparatuses, which are essential to the formation and transfer of a toner image, are mentioned. However, the present invention is also applicable to various combinations of an image forming apparatus, such as those in the following embodiments, and additional devices, equipment, casing (external shell), etc. For example, the present invention is also applicable to a printer, a copying machine, a facsimile machine, a multifunction image forming apparatus, etc.

<Image Forming Apparatus>

Figure 1:
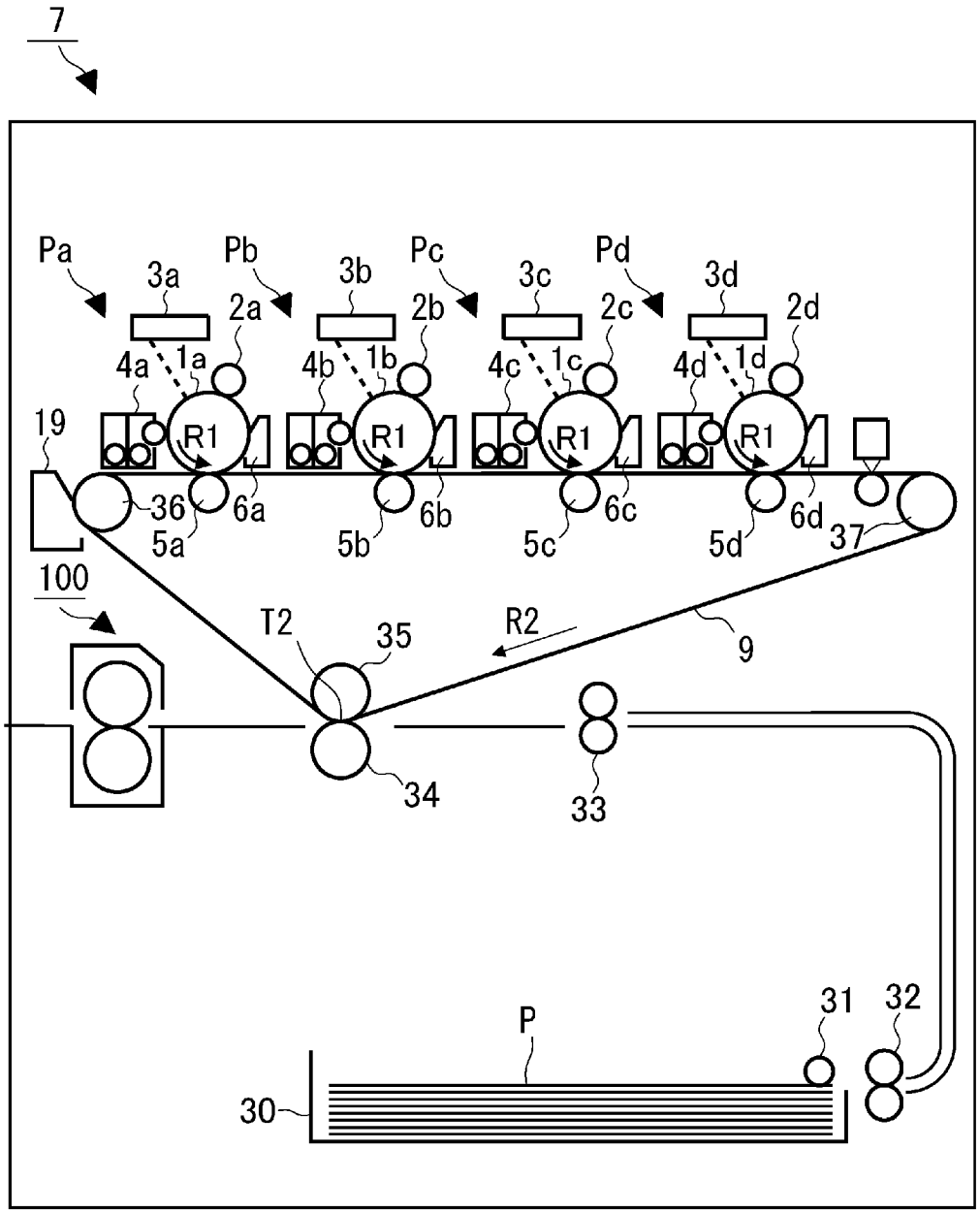
FIG. 1 is a schematic sectional view of a typical image forming apparatus to which the present invention is applicable, and shows the general structure of the apparatus.

FIG. 1 is a drawing for describing a typical image forming apparatus to which the present invention is applicable. An image forming apparatus 7, shown in FIG. 1, is a full-color printer of the so-called tandem type, and also, of the indirect transfer type. Thus, it has an intermediary transfer belt 9, and four image formation stations Pa, Pb, Pc and Pd which form yellow, magenta, cyan, and black monochromatic images, respectively. The four image formation stations are aligned in tandem in the adjacencies of the intermediary transfer belt 9.

In the image formation station Pa, a yellow toner image is formed on its photosensitive drum 1*a*, and is transferred onto the intermediary transfer belt 9. In the image formation station Pb, a magenta toner image is formed on its photosensitive drum 1*b*, and is transferred onto the intermediary transfer belt 9. In the image formation stations Pc, and Pd, cyan and black toner images are formed on photosensitive drums 1*c* and 1*d*, respectively, and are transferred onto the intermediary transfer belt 9.

While the toner images, different in color, are formed as described above, a sheet P of a recording medium is moved out of a recording medium cassette 30, and is kept on standby by a pair of registration rollers 33, which releases the sheet P with such a timing that the sheet P arrives at the secondary transfer station T2 at the same time as the toner image on the intermediary transfer belt 9 arrives at the secondary transfer station T2. In the secondary transfer station T2, the toner images on the intermediary transfer belt 9 are transferred onto the sheet P. After the transfer of the toner images, different in color, onto the sheet P, the sheet P is sent to the fixing device 100, in which the toner images on the sheet P are fixed to the sheet P by the heat and pressure applied to the sheet P and the toner images thereon, by the fixing device 100. Then, the sheet P is discharged into an external delivery tray of the image forming apparatus 7.

The image formation stations Pa, Pb, Pc and Pd are roughly the same in structure, although they are different in the color (yellow, magenta, cyan, and black) of the toner which their respective developing devices 4*a*, 4*b*, 4*c* and 4*d* use. Hereafter, therefore, only the image formation station Pa is described. That is, the image formation stations Pb, Pc and Pd are not going to be described in order not to repeat the same description.

The image formation station Pa has the photosensitive drum 1*a*, and means for processing the photosensitive drum 1*a*, which are a charging roller 2*a*, an exposing device 3*a*, a developing device 4*a*, a primary transfer roller 5*a*, and a drum cleaning device 6*a*, which are in the adjacencies of the peripheral surface of the photosensitive drum 1*a*.

The charge roller 2*a* uniformly charges the peripheral surface of the photosensitive drum 1*a* to a preset level. The exposing device 3*a* writes an electrostatic image of the yellow monochromatic image on the peripheral surface of the photosensitive drum 1*a* by scanning the uniformly charged portion of the peripheral surface of the photosensitive drum 1*a* with the beam of laser light which it emits. The developing device 4*a* develops the electrostatic image on the peripheral surface of the photosensitive drum 1*a* into a visible image, that is, an image formed of toner. As voltage is applied to the primary transfer roller 5*a*, the toner image on the photosensitive drum 1*a* is transferred onto the intermediary transfer belt 9 (primary transfer) by the primary transfer roller 5*a*.

<Fixing Device>

Figure 2:
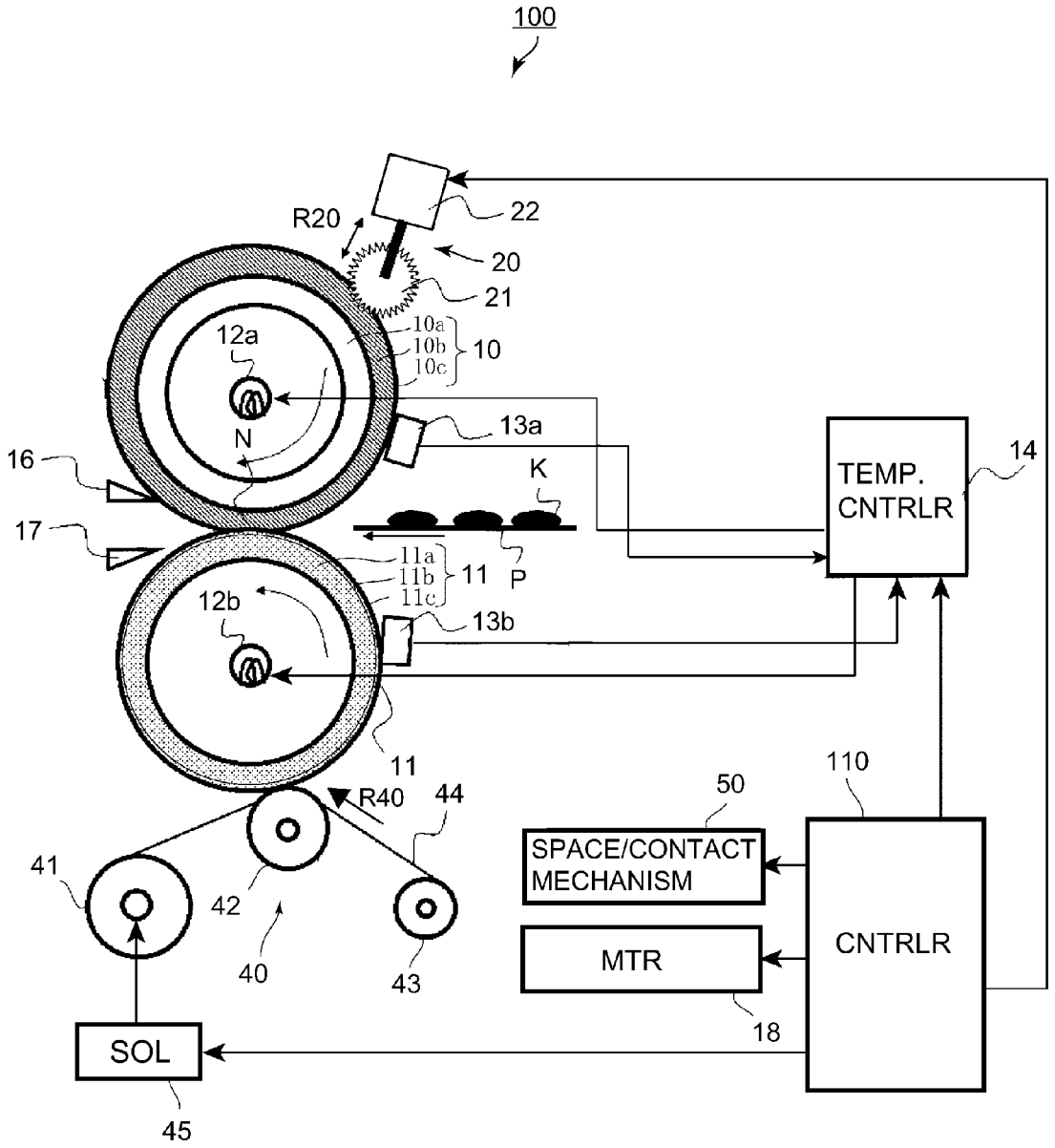
FIG. 2 is a schematic sectional view of a typical fixing device to which the present invention is applicable, and shows the general structure of the device.
Figure 3:
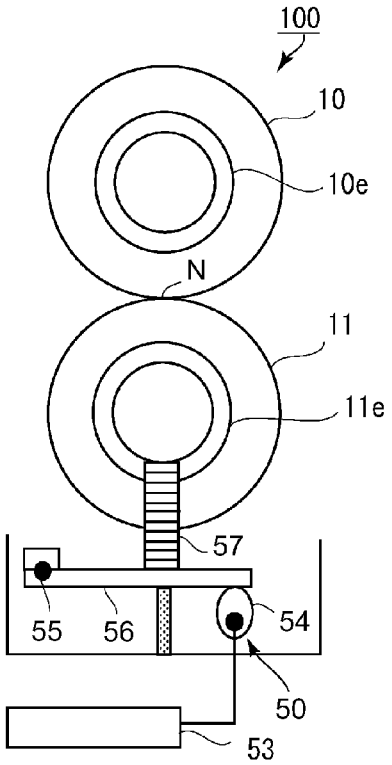
FIG. 3 is a schematic sectional view of the mechanism for moving the pressure roller of the fixing device in accordance with the present invention.
Figure 3:
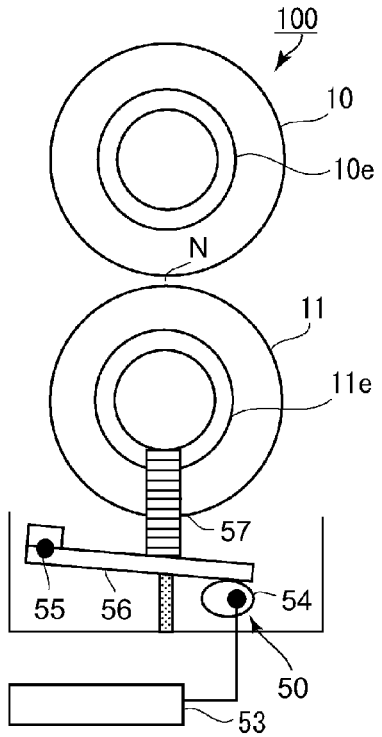

FIG. 2 is a schematic sectional view of a typical fixing device to which the present invention is applicable. It shows the general structure of the device. FIG. 3 is a mechanism for moving the pressure roller of the fixing device shown in FIG. 2, and is for describing the mechanism.

Referring to FIG. 2, the fixing device 100 is of the thermal roller type. It has a fixation roller 10 (rotational heating member) for heating a sheet of a recording medium and the toner image thereon, and a pressure roller 11 (nip forming member). It is structured so that the pressure roller 11 is pressed upon the fixation roller 10 to form a heating nip N between the two rollers 10 and 11. The fixation roller 10 and the pressure roller 11 are in direct mechanical connection to each other through a gear train attached to one end of the fixation roller 10 and one end of the pressure roller 11 in terms of the direction parallel to the axial lines of the two rollers 10 and 11. They convey a sheet P of the recording medium by being driven together by a motor 18.

The fixation roller 10 is made up of an aluminum cylinder 10*a*, an elastic layer 10*b*, and a parting layer 10*c*. The aluminum cylinder 10*a* is 2 mm in thickness. The elastic layer 10*b* is formed of silicone rubber, on the peripheral surface of the aluminum cylinder, and covers the entirety of the peripheral surface of the aluminum cylinder 10*a*. It is 12 mm in thickness. The parting layer 10*c* is formed of fluorinated resin (PTFE), on the outward surface of the elastic layer 10*b*. It is coated on the peripheral surface of the elastic layer 10*b* in such a manner that it covers the entirety of the outward surface of the elastic layer 10*b*. It is 20 μm in thickness. The external diameter of the fixation roller 10 is 50 mm.

The pressure roller 11 is made up of an aluminum cylinder 11*a*, an elastic layer 11*b*, and a parting layer 11*c*. The aluminum cylinder 10*a* is 2 mm in thickness. The elastic layer 10*b* is formed of silicone rubber, on the peripheral surface of the aluminum cylinder, and covers the entirety of the peripheral surface of the aluminum cylinder 11*a*. It is 25 μm in thickness. The parting layer 11*c* is a piece of fluorinated resin tube 11*c* formed of fluorinated resin (PTA), and covers the entirety of the outward surface of the elastic layer 11*b*. It is 50 μm in thickness. The external diameter of the pressure roller 11 is 50 mm.

The fixing device 100 is also provided with a pair of sheet separating claws 16 and 17, that is, top and bottom sheet separating claws (which hereafter will be referred to simply as top and bottom separation claws, respectively). The top separation claw 16 is positioned in such an attitude that its sheet separating edge remains in contact with the peripheral surface of the fixation roller 10, on the upstream side of the heating nip N, in terms of the rotational direction of the fixation roller 10. The top separation claw 16 is for separating (clawing away) the leading edge of a sheet P of the recording medium from the fixation roller 10 to prevent such a jam that occurs as the sheet P wraps around the fixation roller 10, if the leading edge of the sheet P happens to fail to separate from the fixation roller 10. The bottom separation claw 17 is positioned in such an attitude that its sheet separating edge remains in contact with the peripheral surface of the pressure roller 11, on the upstream side of the heating nip N, in terms of the rotational direction of the fixation roller 11. It is for separating (clawing away) the leading edge of the sheet P from the peripheral surface of the pressure roller 11 to prevent such a jam that occurs to the fixing device 100 as the sheet P wraps around the pressure roller 11, if the leading of the sheet P happens to fail to separate from the peripheral surface of the pressure roller 11.

The fixing device 100 has also a halogen heater 12*a* (first heat source), a thermistor 13*a*, and a temperature controller 14. The halogen heater 12*a* is positioned to be stationary in the hollow of the fixation roller 10 to heat the inward surface of the fixation roller 10 with the infrared light it radiates. The thermistor 13*a* is a temperature sensing element, and is positioned on the entrance side of the heating nip N to detect the surface temperature of the fixation roller 10. The temperature controller 14 turns on or off the halogen heater 12*a*, in response to the output signal of the thermistor 13*a*, in order to keep the surface temperature of the fixation roller 10 at 160° C. during an image forming operation.

The fixing device 100 has also a halogen heater 12*b* and a thermistor 13*b*. The halogen heater 12*b* (second heat source) is positioned to be stationary in the hollow of the pressure roller 11 to heat the inward surface of the pressure roller 11 with the infrared light it radiates. The thermistor 13*b* is a temperature sensing element, and is positioned on the entrance side of the heating nip N to detect the surface temperature of the pressure roller 11. The temperature controller 14 turns on or off the halogen heater 12*b*, in response to the output signal of the thermistor 13*b*, in order to keep the surface temperature of the pressure roller 10 at 100° C. during an image forming operation. If the surface temperature of the pressure roller 11 becomes higher than a target level, a fan blows air upon the pressure roller 11.

Referring to FIG. 3(*a*), the control section 110 (controller) separates the pressure roller 11 from the fixation roller 10 by rotating the eccentric cam 54 by controlling the motor 53. Each of the pair of bearings 10*e* of the fixation roller 10 is solidly attached to the frame of the fixing device 100. Each bearing 11*e* of the pressure roller 11 is supported by the arm 56 which is pivotally movable relative to the frame of the fixing device 100, about the pivot 55, with the placement of a spring 57 between the bearing 11*e* and arm 56.

Next, referring to FIG. 3(*b*), the controller 110 separates the pressure roller 11 from the fixation roller 10 by controlling the motor 53, and keeps the fixing device 100 on standby while keeping the temperature of the fixation roller 10 and that of the pressure roller 11 at their target levels. As an image forming operation begins, the controller 110 immediately presses the pressure roller 11 upon the fixation roller 10, forming the heating nip N (for heating sheet P), before the leading edge of the sheet P of the recording medium reaches the fixing device 100. Then, it keeps the pressure roller 11 pressed upon the fixation roller 10, as shown in FIG. 3(*a*), until the formation of the last image in the image forming job is completed.

<Web-Type Cleaning Device>

The web-type cleaning device 40 removes the toner particles, paper dust, and the like contaminants having adhered to the pressure roller 11, by making its cleaning web 44 rub the peripheral surface of the pressure roller 11. The cleaning web 44 is unrolled from the web supply roller 43 in the direction indicated by an arrow mark R40, which is opposite to the rotational direction of the pressure roller 11. As it is unrolled, it is supported by a web support roller 42, being thereby placed in contact with the peripheral surface of the pressure roller 11, while being taken up by the take-up roller 41.

The cleaning web 44 is made of unwoven cloth made of polyamide. It is 50 μm in thickness. It is soaked with silicone oil which is 10,000 cps in viscosity. As the peripheral surface of the pressure roller 11 is rubbed by the cleaning web 44, the silicone oil in the cleaning web 44 transfers onto the peripheral surface of the pressure roller 11, and forms a silicone oil film on the peripheral surface of the pressure roller 11. Some portions of the silicone oil film are absorbed by the sheet P of the recording medium. Thus, the silicone oil film remains roughly stable on the peripheral surface of the pressure roller 11.

The take-up roller 41 is supported by a one-way clutch, which is supported by an arm, which in turn is attached to a solenoid actuator 45 by one end. Thus, it is ensured that the cleaning web 44 can be intermittently unrolled from the supply roller 43 by a preset small amount by the turning on and off the solenoid actuator.

More concretely, the controller 110 intermittently rotates the take-up roller 41 by controlling the solenoid actuator 45, to make the take-up roller to take up the cleaning web 44 by a preset amount. In order to minimize the image forming apparatus in the operational cost related to the cleaning web 44, the frequency with which the cleaning web 44 is replaced is desired to be as low as possible. Thus, the length of the cleaning web 44 taken up in the normal operation is set to 0.05 mm per sheet P of the recording medium; the cleaning web 44 is taken up extremely slowly. In the normal operation, even 0.05 mm per sheet P is sufficient to ensure that the peripheral surface of the pressure roller 11 is satisfactorily cleaned.

The web support roller 42 is 24 mm in external diameter, and is made up of a stainless steel roller and a sponge layer. The stainless roller is 8 mm in diameter. The sponge layer covers the entirety of the peripheral surface of the stainless steel roller. It is formed of open-cell foamed silicone rubber, and is 8 mm in thickness. The web support roller 42 is kept pressured toward the pressure roller 11 by an unshown pressing mechanism, by its end portions in terms of the direction parallel to its rotational axis, whereby it keeps the cleaning web 44 pressed upon the peripheral surface of the pressure roller 11. In terms of the direction parallel to the rotational direction of the pressure roller 11, the dimension of the area of contact between the cleaning web 44 and pressure roller 11 is roughly 6 mm.

<Buffing Device>

In the field of an electrophotographic image forming apparatus, a fixing device (apparatus) which coats the peripheral surface of its fixation roller with oil has long been the mainstream fixing device. In recent years, however, an oil-less fixing device, that is, a fixing device which uses toner which contains a parting agent, instead of coating its fixation roller with oil, has come to be widely used.

An oil-less fixing device is meritorious in that it does not output a print which suffers from streaky contamination attributable to the oil and/or non-uniformity in gloss. Thus, employing a combination of an oil-less fixing device and improved toner by an image forming apparatus can make it possible for the apparatus to output a high quality image on a sheet of a high gloss recording medium.

However, an oil-less fixing device employs a fixation roller, the elastic layer of which is covered with a parting layer, which is a piece of tube made of fluorinated resin, or is formed by coating the outward surface of the elastic layer with fluorinated resin. Thus, the parting layer is susceptible to scratches. Thus, as a substantial number of prints, which are the same in size, are continuously outputted, the portions of the peripheral surface of the fixation roller 10 (parting layer), which correspond in position to the lateral edges of the sheet of recording medium (recording medium path), are likely to be scarred (paper burr damage). The texture of the peripheral surface of a fixation roller is transferred onto the surface of the layer of melted toner (toner image). Thus, as the peripheral surface of a fixation roller 10 sustains scratches, the fixing device is likely to output an image which is non-uniform in gloss.

Thus, the fixing device 100, which is in accordance with the present invention, is operated in a buffing mode for every preset number of prints. In the buffing mode, the peripheral surface of the fixation roller 10 is buffed (rubbed) by a buffing roller 21 (rotational buffing member) to uniformly roughen the peripheral surface of the fixation roller 10, which comes into contact with an unfixed toner image, in order to restore the surface of the fixation roller 10.

As the peripheral surface of the fixation roller 10 is made to sustain fine scratches, across its entire heating range in terms of its lengthwise direction, the scratches made in the peripheral surface of the fixation roller 10 by the recording medium burr become inconspicuous to the human eye. More concretely, the peripheral surface of the fixation roller 10 is buffed to be evened in surface texture, in order to prevent the fixing device 100 from outputting an image which is non-uniform in gloss. The buffing roller is for forming fine scratches in the peripheral surface of the fixation roller 10 across the entire heating range of the fixation roller 10 in terms of the lengthwise direction of the fixation roller 10. It is not for ridding the peripheral surface of the fixation roller 10 of the scars attributable to the burrs which some sheets of the recording medium have along their edges. That is, it is for slightly roughening the peripheral surface of the fixation roller 10 in order to make the peripheral surface of the fixation roller uniform in surface texture. With the fixation roller being made uniform in surface texture, the fixing device 100 is unlikely to output an image which is non-uniform in gloss. In other words, the buffing roller 21 is used to restore the fixation roller 10 in terms of the surface uniformity by buffing the peripheral surface of the fixation roller 10.

The buffing device 20 has the buffing roller 21, and an unshown motor for driving the buffing roller 21. It restores the peripheral surface of the fixation roller 10 in terms of surface texture, by causing the buffing roller 21 to rub the fixation roller 10 while the fixation roller 10 is rotating.

The buffing roller 21 is made up of a stainless steel cylinder, and abrasive particles adhered to the peripheral surface of the stainless cylinder with the presence of a layer of adhesive between themselves and the peripheral surface of the cylinder. The abrasive particles are made of so-called "Alundum" or "Molandum", which are types of alumina (aluminum oxide). The aluminum-based abrasive particles are the most widely used abrasive grain (particle). They are substantially harder than the peripheral surface of the fixation roller 10, and are jagged, being therefore excellent as the abrasive grain for buffing the peripheral surface of the fixation roller 10. Therefore, they are desirable as the material for roughening the peripheral surface of the fixation roller 10.

There are the other abrasive grains than aluminum-based ones, for example, aluminum oxide, aluminum hydroxide, silicon oxide, cerium oxide, titanium oxide, zirconia, lithium silicate, silicon nitride, silicon carbide, iron oxide, chrome oxide, antimony oxide, diamond, and the like, which also can be used as abrasive grain. The mixture of these abrasive grains can also be used as the material for the buffing roller 21.

The pressure roller moving mechanism 22 can move the buffing roller 21 in the direction indicated by a two-headed arrow mark R20 in FIG. 2, to place the buffing roller 21 in contact with, or separated from, the fixation roller 10, while the fixation roller 10 is rotated in the opposite direction from the rotational direction of the buffing roller 21. More specifically, the mechanism 22 presses the buffing roller 21 upon the peripheral surface of the fixation roller 10 in such a manner that the buffing roller hypothetically intrudes into the fixation roller 10 by a preset distance, creating thereby a buffing nip between the buffing roller 21 and fixation roller 10.

The rotational direction of the buffing roller 21 may be the same as, or opposite to, the rotational direction of the fixation roller 10. What is important here is that the buffing roller 21 is different in peripheral velocity from the fixation roller 10 while they are in contact with each other.

As the buffing roller 21 is placed in contact with the fixation roller 10 while the two rollers are rotated, while being kept different in peripheral velocities, and/or rotational direction, the peripheral surface of the fixation roller 10 sustains fine scratches, across its entire heating range (including sheet path, out-of-sheet-path area, and portions which correspond in position to sheet edge burrs) in terms of the direction parallel to the rotational axis of the fixation roller 10. Thus, the fine scratches attributable to the buffing roller 21 overlap with the scratches, which are attributable to the repeated encountering of the fixation roller 10 with the lateral edges of a sheet P of the recording medium, and therefore, coincide in position to the lateral edges of the recording medium path. Consequently, the fixing device 10 (image forming apparatus) outputs an image, the imperfections of which attributable to the scars made by the burrs which the lateral edges of a sheet of the recording medium caused, are inconspicuous to the human eye.

That is, even though the buffing roller 21 is made to buff the peripheral surface of the fixation roller 10, it is not for buffing the peripheral surface of the fixation roller 10 to rid the fixation roller 10 of the scratches attributable to the burrs which the lateral edges of a sheet of the recording medium have. In other words, the buffing roller 21 is made to buff the peripheral surface of the fixation roller 10 just enough to make inconspicuous the scratches attributable to the sheet edges (burrs). Therefore, even after the buffing of the peripheral surface of the fixation roller 10 by the buffing roller 21, the scratches attributable to the sheet edges still remain.

It is desired that the manner in which the peripheral surface of the fixation roller 10 is buffed by the buffing roller 21 is such that satisfies the following two conditions: (1) The surface roughness Rz of the peripheral surface of the fixation roller 10 after buffing is in a range of 0.5 μm-2.0 μm, and (2) The grooves which buffing creates are no more than 10 μm in width in terms of the lengthwise direction of the fixation roller 10, and the number of grooves, per 100 μm in terms of the lengthwise direction of the fixation roller 10 is no less than 10.

The peripheral surface of the fixation roller 10 does not change in the state of the grooves created by the buffing, and/or roughness, for a substantial length of actual usage of the fixing device 100, after the buffing of the peripheral surface of the fixation roller 10 (remains roughly the same even after conveyance of several thousand of sheets of paper through fixation nip N).

The surface roughness Rz (JIS: ten point average roughness) can be measured with the use of a surface roughness gauge SE-3400 (product of Kosaka Laboratory Ltd.). More specifically, it was measured under the following conditions: 0.5 mm/s in speed; 0.8 mm in cutoff; and 2.5 mm in length of measurement. These values were the same as those obtainable using other surface roughness measuring devices.

The number of the grooves in the peripheral surface of the fixation roller 10 and the width of the groove can be measured with the use of a laser microscope VK8500 (product of Keyence Co., Ltd.). These values will be the same as those obtainable with the use of the other optical or contact measuring devices.

The portion of the fixation roller 10, which is to be measured in the number of the grooves and groove width in order to ensure that the entire heating range of the peripheral surface of the fixation roller 10 in terms of the lengthwise direction of the fixation roller 10 is covered with the grooves attributable to the buffing operation, should be such one that does not come into contact with even a largest (widest) sheet of the recording medium in terms of the lengthwise direction of the fixation roller 10, but, comes into contact with the smallest (narrowest) sheet of the recording medium.

The grooves formed by the buffing operation are different from the scars, scratches, and the like, which the peripheral surface of the fixation roller 10 sustains, in that they cover the virtually entirety of the peripheral surface of the fixation roller 10, that is, regardless of the contact between the peripheral surface of the fixation roller 10 and a sheet of the recording medium. Thus, the difference of the grooves attributable to the buffing of the peripheral surface of the fixation roller 10 by the buffing roller 21, from the other imperfections than the grooves formed by the buffing roller 21, can be detected by examining the peripheral surface of the fixation roller 10 with the use of a laser microscope VK800 (product of Keyence Co., Ltd.).

Embodiment 1

Figure 4:
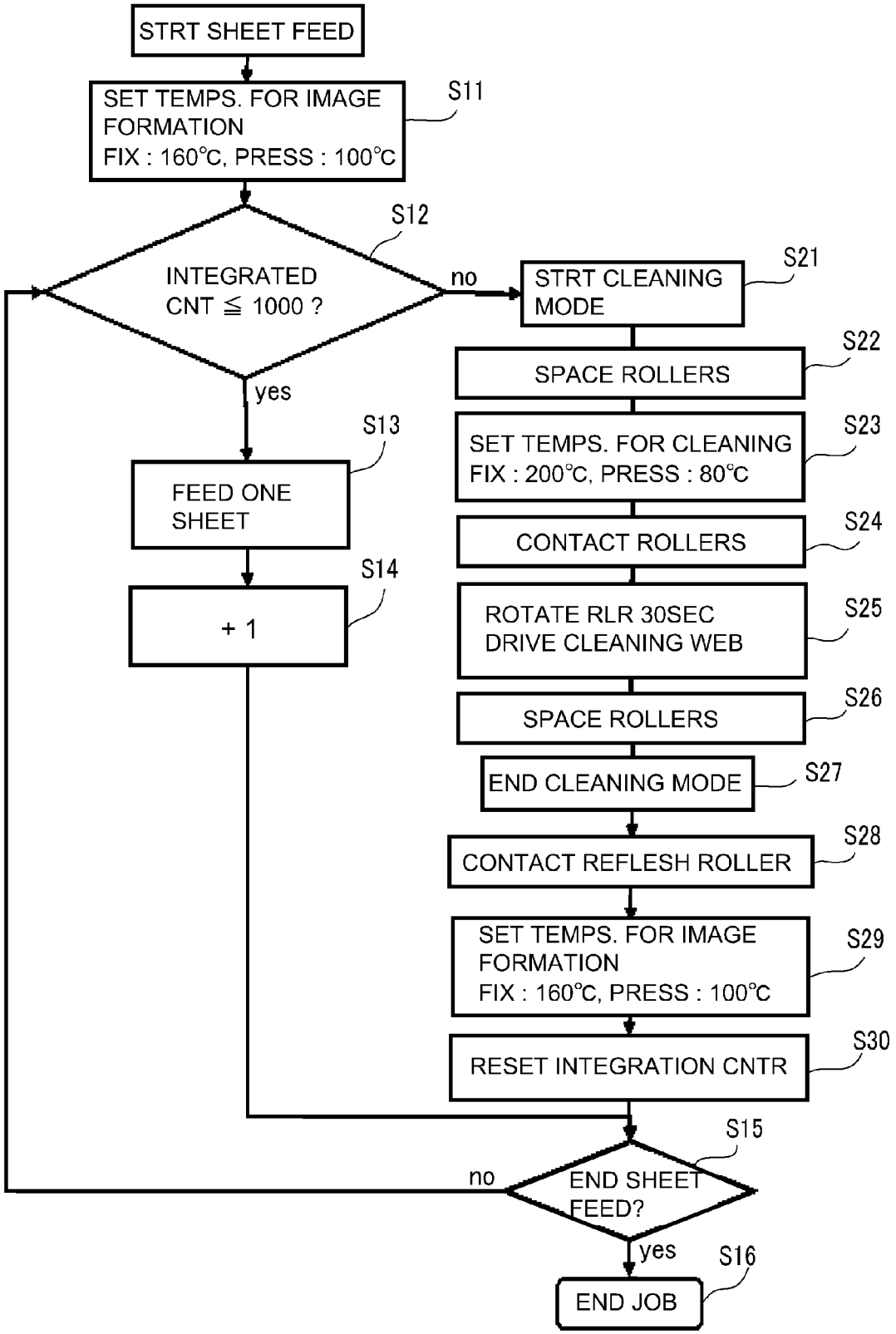
FIG. 4 is a flowchart of the control sequence for the operation for buffing the fixation roller, in the first embodiment of the present invention.

FIG. 4 is a flowchart of the control sequence, in the first embodiment of the present invention, for the operation for buffing the peripheral surface of the fixation roller 10 with the buffing roller 21. In the first embodiment, the offset toner on the fixation roller 10, that is, the toner having transferred onto the peripheral surface of the fixation roller 10 from a sheet of the recording medium, on which unfixed toner image was present, is recovered by the web-type cleaning device 40 by way of the pressure roller 11, immediately before the fixing device 100 begins to be operated in the buffing mode (cleaning mode).

Referring to FIG. 2, the fixation roller 10, which is an example of a rotational heating member, heats the image bearing surface of a sheet of the recording medium. The pressure roller 11, which is an example of a pressure applying rotational member, is positioned so that it can be placed in contact with (pressed upon) the fixation roller 10 to form a nip for heating the image on the sheet of the recording medium, between the two rollers 10 and 11, or can be separated from the fixation roller 10. The buffing roller 21, which is an example of a buffing means, is positioned so that it can be placed in contact with, or separated from, the fixation roller 10. As it is placed in contact with the fixation roller 10, it buffs (rubs) the peripheral surface of the fixation roller 10. The web-type cleaning device 40, which is an example of cleaning means, cleans the peripheral surface of the pressure roller 11 by rubbing the peripheral surface of the pressure roller 11, with its unwoven cleaning web 44.

The control section 110, which is an example of controlling means, operates the fixing device 100 in the cleaning mode (first mode) before it makes the buffing roller 21 buff the fixation roller 10 (second mode). In the cleaning mode, the control section 110 makes the fixation roller 10 rotate at least one full turn while keeping the pressure roller 11 in contact with the fixation roller 10. As soon as it ends operating the fixing device 100 in the cleaning mode, it separates the pressure roller 11 from the fixation roller 10, and begins to place the buffing roller 21 in contact with the fixation roller 10.

In the cleaning mode, the web-type cleaning device 40 is kept at a higher level in terms of its ability to clean the pressure roller 11, than in the normal mode, that is, the mode in which a sheet of the recording medium and the toner image thereon are heated by the fixation roller 10. The speed at which the cleaning web of the cleaning device 40 is moved in the cleaning mode is higher than that in the normal mode in which a sheet P of the recording medium and the toner image thereon are heated (which may be referred to simply as recoding medium heating mode).

Also in the cleaning mode, the pressure roller 11 is kept at a higher level in terms of its ability to remove toner from the peripheral surface of the fixation roller 10, than in the recording medium heating mode. The control section 110, which is an example of an adjusting means, adjusts at least one of the fixation roller 10 and pressure roller 11 in temperature in such a manner that the difference between the temperature of the fixation roller 10 and that of the pressure roller 11 in the cleaning mode will be greater than that in the recording medium heating mode. More concretely, the surface temperature of the pressure roller 11 in the cleaning mode is set to a lower level than that in the recording medium heating mode, or the surface temperature of the fixation roller 10 is set to a higher level than that in the recording medium heating mode.

The control section 110 operates the fixing device 100 in the cleaning mode immediately before it places the buffing roller 21 in contact with the fixation roller 10 in order to rid the fixation roller 10 of the offset toner, that is, the toner having transferred onto the fixation roller 10 from a sheet of the recording medium having unfixed toner image. Therefore, it is ensured that the buffing roller 21 is not contaminated by the offset toner on the fixation roller 10 during the subsequent fixation roller buffing operation.

Next, referring to FIG. 4 along with FIG. 2, the control section 110 sets the target temperatures for the fixation roller 10 and pressure roller 11 to 160° C. and 100° C., respectively, and starts an image forming operation (S11).

The control section 110 is provided with a counter for cumulatively counting how many sheets of the recording medium were processed for image fixation after the fixing device 100 was operated in the buffing mode for the last time. Each time a sheet of the recording medium is processed (S13), the control section 110 adds one to the value in the counter (S14). As the value in the counter reaches 1,000 (No in S12), the control section 110 begins to operate the fixing device 100 in the cleaning mode (S21).

Then, the control section 110 separates the pressure roller 11 from the fixation roller 10 (S22), and changes the temperature setting of the fixation roller 10 and pressure roller 11, from the normal levels to the levels for the cleaning mode, respectively. More specifically, in the cleaning mode, the target temperature levels for the fixation roller 10 and pressure roller 11 are set to 200° C. and 80° C., respectively (S23).

Then, the control section 110 increases the output of the halogen heater 12*a* in, and turns off the halogen heater 12*b*. As the temperatures of the fixation roller 10 and pressure roller 11 reach their target levels, the control section 110 places the pressure roller 11 in contact with the fixation roller 10 (S24), and rotates the fixation roller 10 and the pressure roller 11 for 30 seconds while keeping the two rollers in contact with each other (S25). From the standpoint of increasing the rate at which the pressure roller 11 decreases in temperature in the cleaning mode, it is desired that air is blown at the pressure roller 11 by a fan.

The temperature setting for the fixation roller 10 and pressure roller 11 in the cleaning mode is such that the difference in temperature between the fixation roller 10 and pressure roller 11 in the cleaning mode is greater than that in the normal operational mode. Therefore, the offset toner on the fixation roller 10 is efficiently transferred onto the pressure roller 11.

TABLE 1

| | Normal | Cleaning mode |
|---|---|---|
| Fixing roller temp. (deg. C.) | 160 | 200 |
| Pressing roller temp. (deg. C.) | 100 | 80 |
| Winding speed (mm/sec) | 0.05 | 0.1 |

The toner having transferred from the fixation roller 10 onto the pressure roller 11 is removed by the web-type cleaning device 40 while the two rollers are rotated in contact with each other for 30 seconds. Further, in the cleaning mode, the speed with which cleaning web is taken up is set to be faster by the web-type cleaning device 40 than in the normal operational mode. Since the cleaning web 44 is intermittently taken up, the "speed" at which the cleaning web 44 is taken up is the "average speed" at which the cleaning web 44 is taken up. The speed (length by which cleaning web is taken up per unit length of time) at which the cleaning web 44 is taken up during the normal (image forming operation) is set to 0.05 mm per second, whereas the speed at which the cleaning web 44 is taken up in the cleaning mode is set to 0.1 mm per second, which is twice the speed at which the cleaning web 44 is taken up in the normal operational mode. Thus, in the cleaning mode, it is harder for the offset toner on the pressure roller 11 to move past the nip between the pressure roller 11 and cleaning web 44 than in the normal mode. In other words, it is ensured, by making the cleaning mode higher in the speed at which the cleaning web 44 is taken up than the normal mode, that the offset toner made to transfer from the fixation roller 10 onto the pressure roller 11 is wiped away by the cleaning web 44.

After 30 seconds, the control section 110 separates the pressure roller 11 from the fixation roller 10 (S26), and ends operating the fixing device 100 in the cleaning mode (S27). Then, it starts operating the fixing device 100 in the buffing mode.

In the buffing mode, the control section 110 rotates the buffing roller 21 for 10 seconds while keeping the buffing roller 21 rotating in contact with the fixation roller 10, buffing thereby the peripheral surface of the fixation roller 10. Then, it separates the buffing roller 21 from the fixation roller 10 (S28).

After ending the operation for the buffing the fixation roller 10, the control section 110 resets the target temperatures of the fixation roller 10 and pressure roller 11 back to the 160° C. and 100° C., respectively, which are the temperature levels for the normal operation (S29). Then, it resets the cumulative sheet counter (S30).

Then, the control section 110 restarts the interrupted fixing operation. Then, as the preset number of sheets of the recording medium are processed by the fixing device 100 (Yes in S15), the control section 110 ends the image formation job (S16).

In the first embodiment, the fixing device 100 is operated in the cleaning mode, that is, the mode in which the fixation roller 10 is cleaned, before it is operated in the buffing mode. Therefore, the buffing roller 21 is prevented from being contaminated by the offset toner. Since the peripheral surface of the fixation roller 10 is buffed by the buffing roller 21 without positioning the web-type cleaning device 40 to directly clean the fixation roller 10, the buffing roller 21, which is for buffing the peripheral surface of the fixation roller 10, is not contaminated by the offset toner. Further, since the web-type cleaning device 40 is not positioned so that its cleaning web is placed in contact with the fixation roller 10, it does not occur that the peripheral surface of the fixation roller 10 is roughened by the cleaning web. Thus, the peripheral surface of the fixation roller 10 remains normal for a substantially longer period time than the fixation roller (10) of any fixing device in accordance with the prior art.

Further, in order to further ensure that the fixation roller 10 is modified in the texture of its peripheral surface to be enabled to output an image which appears more uniform in gloss than any image outputted by a fixing device in accordance with the prior art, not only is the fixing device 100 operated in the buffing mode with the above described timing, but also, in the post-rotation period, also in which the fixing device 100 is operated in the cleaning mode before it is operated in the buffing mode.

In this embodiment, the fixing device 100 is structured so that the buffing roller 21 can be moved to be placed in contact with, or separated from, the fixation roller 10. However, this embodiment is not intended to limit the present invention, regarding which of the fixation roller 10 and pressure roller 11 the buffing roller 21 is to be buffed by the buffing roller 21. That is, the fixing device 100 may be structured so that the buffing roller 21 is placed in contact with, or separated from, the pressure roller 11.

Further, the fixing device 100 in this embodiment is structured so that only a single value is set for the target temperature for the fixation roller 10 in the normal operation, and also, so that only a single value is set for the pressure roller 11 in the normal operation. However, the present invention is also compatible with a fixing device structured so that the target temperatures for the fixation roller 10 and pressure roller 11 in the normal operation can be adjusted in multiple steps according to the recording medium type (paper type). All that is necessary in a case where the present invention is applied to such a fixing device is that the device is structured so that the target temperature for the cleaning mode be set higher than the highest target temperature level in the normal operation.

Further, in this embodiment, the fixing device 100 is structured so that in the cleaning mode, the fixation roller 10 is increased in temperature, whereas the pressure roller 10 is reduced in the target temperature. However, the present invention is also compatible with a fixing device structured so that the pressure roller 11 is not changed in the target temperature in the cleaning mode.

Embodiment 2

Figure 5:
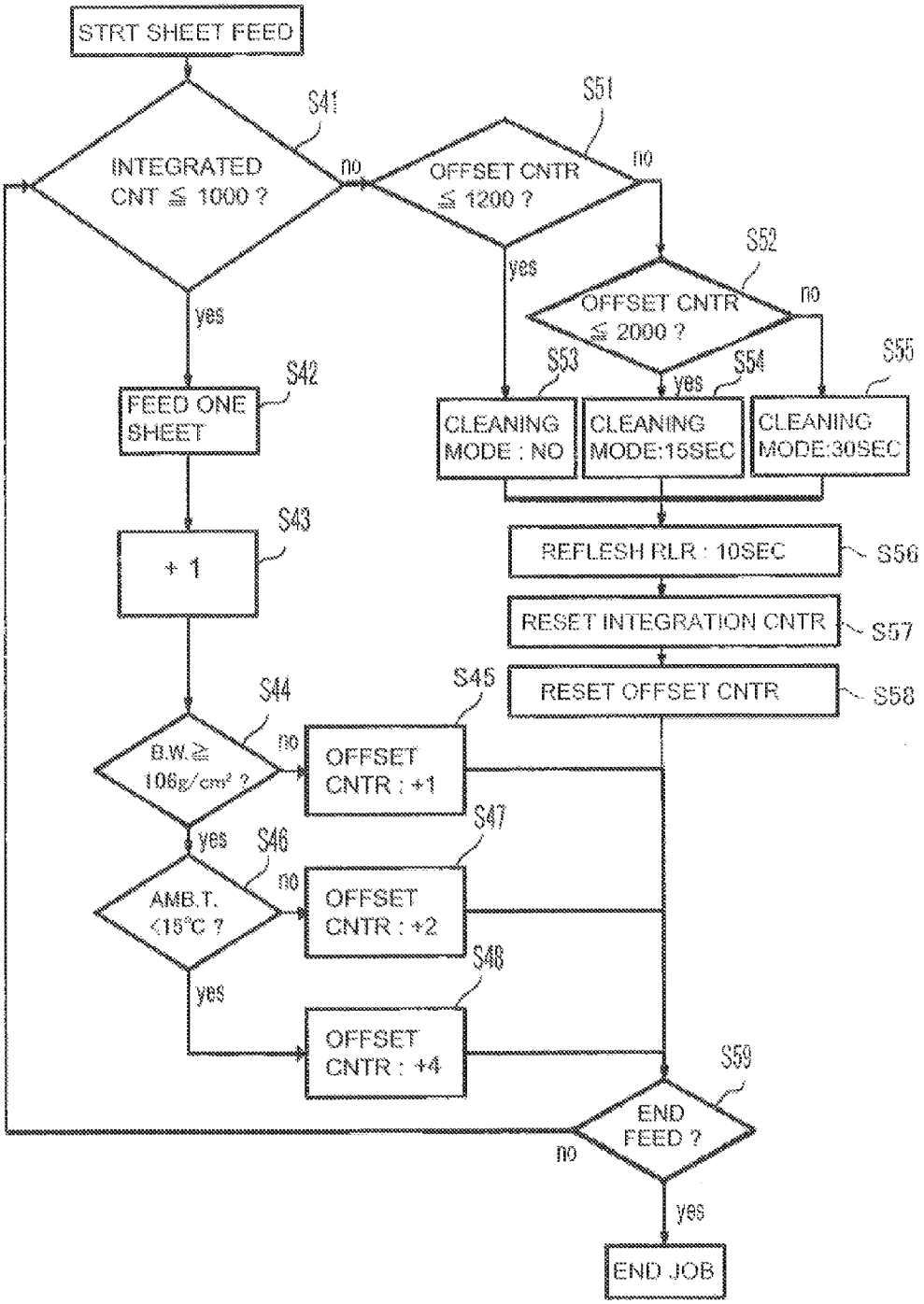
FIG. 5 is a flowchart of the control sequence for the operational sequence for buffing the fixation roller in the second embodiment.

FIG. 5 is a flowchart of the control sequence, in the second embodiment, for the operation for buffing the pressure roller. In the second embodiment, the amount of the offset toner having adhered to the peripheral surface of the fixation roller 10 is estimated. Then, the length of time the fixing device 100 is to be operated in the cleaning mode is set in proportion to the estimated amount of the offset toner on the peripheral surface of the fixation roller 10. In cleaning mode, the greater a sheet of the recording medium is in basis weight, and/or the lower the ambient temperature, the longer the length of time the fixation roller 10 is to be operated in the cleaning mode is set.

Referring to FIG. 2, in this embodiment, the control section 110 is provided with not only the above described cumulative sheet counter for cumulatively counting the number of sheets of the recording medium processed by the fixing device 100, but also, an offset toner amount counter which is for estimating the amount of the offset toner on the fixation roller 10.

Also in the second embodiment, the control section 110 operates the fixing device 100 in cleaning mode before it places the buffing roller 21 in contact with the fixation roller 10, as in the first embodiment, to rid the fixation roller 10 of the offset toner having adhered to the peripheral surface of the fixation roller 10. In the second embodiment, the length of time (in terms of seconds) the fixing device 100 is to be operated in the cleaning mode is set in consideration of the value in the offset toner amount counter. More concretely, in a case where a large number of sheets of thick paper (cardstock) are used as the recording medium and/or the ambient temperature of the image forming apparatus is low in the normal image forming operation carried out immediately before the fixing device 100 was put in the cleaning mode, the length of time the fixing device 100 is to be operated in the cleaning mode is extended to remove the offset toner on the peripheral surface of the fixation roller 10 to meet the higher level of cleanliness requirement. Thus, it is ensured at a higher level of standard that the buffing roller 21 is prevented from being contaminated by the offset toner while the fixation roller 10 is buffed by the buffing roller 21 immediately after the cleaning of the fixation roller 10.

Next, referring to FIG. 5 as well as FIG. 2, after the control section 110 starts an image forming operation, each time a sheet of the recording medium is processed by the fixing device 100, it adds one to the value in the cumulative sheet counter (S43), and also, adds a present value to the value in the offset toner amount counter for estimating the amount of the offset toner on the peripheral surface of the fixation roller 10 (S44-S48). Each time a sheet of the recording medium is processed by the fixing device 100, a preset value is added to the value in the offset toner amount counter, as follows:

(1) In a case where a sheet of the recording medium used for the image formation is a sheet of ordinary paper or thin paper, that is, the sheet of the recording medium is no more than 105 g/m$^2$ basis weight (No in S44), virtually no toner will transfer from a sheet of the recording medium having an unfixed toner image, onto the fixation roller 10. Therefore, the value in the offset toner amount counter is increased by only one (S45);

(2) In a case where a sheet of the recording medium used for the image forming operation is a sheet of thick paper (cardstock) or embossed paper, that is, no less than 105 g/m$^2$ in basis weight, toner will offset from a sheet of the recording medium on which an unfixed toner image is present, and therefore, the ambient temperature is taken into consideration (S46):

(3) In a case where the ambient temperature is no less than 15° C. (No in S46), the toner particles in the unfixed toner image on a sheet of the recording medium will transfer onto the fixation roller 10, although by only a small amount, the value in the offset toner amount counter is increased by two (S47);

(4) In a case where the ambient temperature is no higher than 15° C., the toner particles in the unfixed toner image on a sheet of the recording medium will offset onto the fixation roller 10 by a substantial amount (S47), and therefore, the value in the offset toner amount counter is increased by four (S48).

As the value in the offset toner amount counter reaches 1,000 (No in S41), the control section 110 sets the length of time the fixing device 100 is to be operated in the cleaning mode, in consideration of the value in the offset toner amount counter (S51-S55):

(1) In a case where the value in the offset toner amount counter is no more than 1,200 (Yes in S51), it is reasonable to think that the amount by which toner particles have offset onto the fixation roller 10 from the unfixed toner image on a sheet of the recording medium is very small. Thus, the length of time the fixing device 100 is to be operated in the cleaning mode is set to zero (S53);

(2) In a case where the value in the offset toner amount counter is no less than 1,200 and no more than 2,000 (Yes in S52), the amount of the toner having offset from the unfixed toner image on a sheet of the recording medium is moderate. Therefore, the length of time the fixing device 100 is to be operated in the cleaning mode is set to 15 seconds (S54); and (3) In a case where the value in the offset toner amount counter is no less than 2,000 (No in S52), the amount by which the toner particles in the unfixed toner image on a sheet of the recording medium offset onto the fixation roller 10 is substantial. Therefore, the length of time the fixing device 100 is to be operated in the cleaning mode is set to 30 seconds (S55).

The cleaning mode in which the fixing device 100 is operated in the second embodiment is the same as the one in the first embodiment (S21-S27) in FIG. 4).

The control section 110 separates the pressure roller 11 from the fixation roller 10, and changes the temperature setting of the fixation roller 10 and the pressure roller 11, from the normal levels to the levels for the cleaning mode, respectively. As the temperatures of the fixation roller 10 and pressure roller 11 reach their target levels, the control section 110 places the pressure roller 11 in contact with the fixation roller 10, and rotates the fixation roller 10 and the pressure roller 11 for a preset length of time while keeping the two rollers in contact with each other. Then, the control section 110 separates the pressure roller 11 from the fixation roller 10, and ends operating the fixing device 100 in the cleaning mode, and starts operating the fixing device 100 in the buffing mode.

In the buffing mode, the control section 110 rotates the buffing roller 21 for 10 seconds while keeping the buffing roller 21 rotating in contact with the fixation roller 10, buffing thereby the peripheral surface of the fixation roller 10. Then, it separates the buffing roller 21 from the fixation roller 10.

After ending the operation for the buffing the fixation roller 10, the control section 110 resets the target temperatures for the fixation roller 10 and pressure roller 11 back to the 160° C. and 100° C., respectively, which are the temperature levels for the normal operation. Then, it resets the cumulative sheet counter and offset toner amount counter (S57, S58).

Then, the control section 110 restarts the interrupted fixing operation. Then, as the preset number of sheets of the recording medium are processed by the fixing device 100 (Yes in S59), the control section 110 ends the image formation job.

Generally speaking, the lower the adhesive strength of unfixed toner to a sheet of the recording medium, the greater the amount of the toner offsets from the sheet of the recording medium onto the fixation roller 10. Therefore, in a case where the recording medium used for a given image forming operation is thick paper (cardstock) or embossed paper, for example, and/or in a case where the ambient temperature is no higher than 15° C., that is, the environment in which the image forming apparatus is being used is low in temperature, the amount of heat robbed from the fixing device 100 by a sheet of the recording medium is substantial, and the amount of heat transferred to the unfixed toner image on the sheet of the recording medium is insufficient. Thus, the adhesive strength of the unfixed toner image to the sheet of the recording medium remains relatively small, being therefore relatively large in the amount by which it offsets (transfers) onto the fixation roller 10. In a case where the amount of the toner particles in the unfixed toner image on a sheet of the recording medium offset onto the fixation roller 10 is large, the length of time the fixing device 100 is to be operated in the cleaning mode needs to be set longer than when the fixing device 100 is operated in the normal mode, in order to prevent the buffing roller 21 from being contaminated by the toner having offset onto the pressure roller 11 from the fixation roller 10. In comparison, in a case where the recording medium is ordinary paper or thin paper, and/or the ambient temperature is no less than 20° C., that is, normal, even if a large number of sheets of the recording medium are continuously processed by the fixing device 100, a sufficient amount of heat transfers to the toner particles in the unfixed toner image, because the amount by which heat is robbed by each sheet is very small. Thus, the adhesive strength of the toner to the sheet of the recording medium is substantial. Therefore, the amount of the toner particles in the unfixed toner image offset from the sheet of the recording medium to the fixation roller 10 is very small. Thus, the length of time the fixing device 100 is to be operated in the cleaning mode may be relatively short. In a case where a sheet of thin paper or ordinary paper, that is, the recording medium which is no greater in basis weight than 105 g/m2, is processed by the fixing device 100, the unfixed toner image is sufficient in its adhesive strength to a sheet of the recording medium, and therefore, virtually no toner particles will offset onto the fixation roller 10. Therefore, the value in the offset toner amount counter is increased by only one. In a case where a sheet of the recording medium used for the image forming operation is a sheet of thick paper (cardstock), that is, the recording medium which is no less than 105 g/m$^2$ in basis weight, the unfixed toner image is relatively small in its adhesive strength to a sheet of the recording medium. Therefore, toner will offset from a sheet of the recording medium onto the fixation roller 10, although only by a small amount. Therefore, the value in the offset toner amount counter is increased by two. In a case where a sheet of thick paper (cardstock) is processed by the fixing device 100 when the ambient temperature is no higher than 15° C., that is, when the image forming apparatus is operated in an environment which is relatively low in temperature, the unfixed toner image is even less in its adhesive strength to the sheet of the recording medium (cardstock), and therefore, the toner particles in the unfixed toner image on a sheet of the recording medium (cardboard) will offset onto the fixation roller 10 by a substantial amount. Therefore, the value in the offset toner amount counter is increased by four.

In the second embodiment, in a case where the basis weight of the sheet of the recording medium sent to the fixation nip before the fixing device 100 began to be operated in the buffing mode is greater than a preset value, the length of time the fixation roller 10 and pressure roller 11 are rotated in contact with each other before the buffing roller 21 begins to be placed in contact with the fixation roller 10 is extended. More concretely, the length of time the fixing device 100 is to be operated in the cleaning mode is set according to the cumulative amount by which toner offset from the unfixed toner images on the sheets of the recording medium onto the fixation roller 10 since the fixing device 100 was operated in the buffing mode last time. If the value in the offset toner amount counter is no more than 1,200, it is determined that the amount by which toner particles have offset onto the fixation roller 10 from the unfixed toner image on a sheet of the recording medium is virtually zero. Thus, the fixing device 100 is not operated in the cleaning mode. In a case where the value in the offset toner amount counter is no less than 1,200 and no more than 2,000, the length of time the fixing device 100 is to be operated in the cleaning mode is set to 15 seconds. In a case where the value in the offset toner amount counter is no less than 2,000, the length of time the fixing device 100 is to be operated in the cleaning mode is set to 30 seconds. The timing with which the fixation roller 10 and pressure roller 11 are adjusted in temperature in the cleaning mode, and the timing with which the pressure roller 11 is placed in contact with, or separated from, the fixation roller 10, are the same as those in the first embodiment. After operating the fixing device 100 in the buffing mode, the control section 110 resets both the cumulative sheet counter and cumulative toner offset toner amount counter to zero.

In the second embodiment, the value to be added to the value in the offset toner amount counter is adjusted according to the type of a sheet of the recording medium to be processed by the fixing device 100, and/or ambient temperature. Thus, the cumulative amount of the toner particles having offset onto the fixation roller 10 from the unfixed toner images on the sheets of the recording medium processed by the fixing device 100 is more accurately estimated than in the first embodiment. Further, the condition under which the fixing device 100 is to be operated in the cleaning mode is set according to the estimated amount of the offset toner on the fixation roller 10, that is, according to the condition of the peripheral surface of the fixation roller 10. Therefore, it does not occur that the fixing device 100 is unnecessarily operated in the cleaning mode, or that the fixing device 100 is operated in the cleaning mode longer than necessary. Therefore, it does not occur that the fixing device 100 (image forming apparatus) is unnecessarily kept on standby, or is kept on standby longer than necessary. Thus, the second embodiment of the present can minimize the amount by which an image forming apparatus is reduced in productivity by the operation for cleaning the fixation roller 10.

Embodiment 3

In the second embodiment, the length of time the fixing device 100 is operated in the cleaning mode is adjusted according to the estimated amount of the offset toner on the fixation roller 10. In comparison, in the third embodiment, the frequency with which the fixing device 100 is put in the cleaning mode is adjusted according to the estimated amount of the offset toner on the fixation roller 10. That is, the greater in basis weight the sheet of the recording medium, and/or lower the ambient temperature, the higher the frequency with the fixing device 100 is operated in the cleaning mode.

Each time a sheet of the recording medium is processed by the fixing device 100, the control section 110 adds a preset value to the value in the offset toner amount counter. Then, as the value in the offset toner amount counter reaches 1,200, it operates the fixing device 100 in the cleaning mode, and then, in the buffing mode, that is, the mode in which the buffing roller 21 is used. However, it is not mandatory that the fixing device 100 be operated in the buffing mode each time the fixing device 100 is operated in the cleaning mode. That is, the fixing device 100 may be designed so that it is operated in the buffing mode for every preset number of times it is operated in the cleaning mode.

Embodiment 4

In the fourth embodiment, the fixing device 100 is provided with another web-type cleaning device 40, which is for the fixation roller 10. This web-type cleaning device 40 is structured so that the amount of pressure at which its unwoven cleaning web is pressed upon the fixation roller 10 can be varied.

In the cleaning mode, the contact pressure between the cleaning web 44 and fixation roller 10 is set higher than in the normal mode, that is, the mode for heating a sheet of the recording medium. That is, in the normal mode, the contact pressure between the cleaning web 44 and fixation roller 10 is kept lower to prevent the fixation roller 10 from sustaining scratches.

In the preceding embodiments, the offset toner is removed with the use of the web-type cleaning device 40. However, the present invention is also compatible with a cleaning device having a cleaning roller made of rubber, a brushing roller, or the like, instead of the cleaning web, and also, a cleaning device which blows air at an object to be cleaned.

Figure 6:
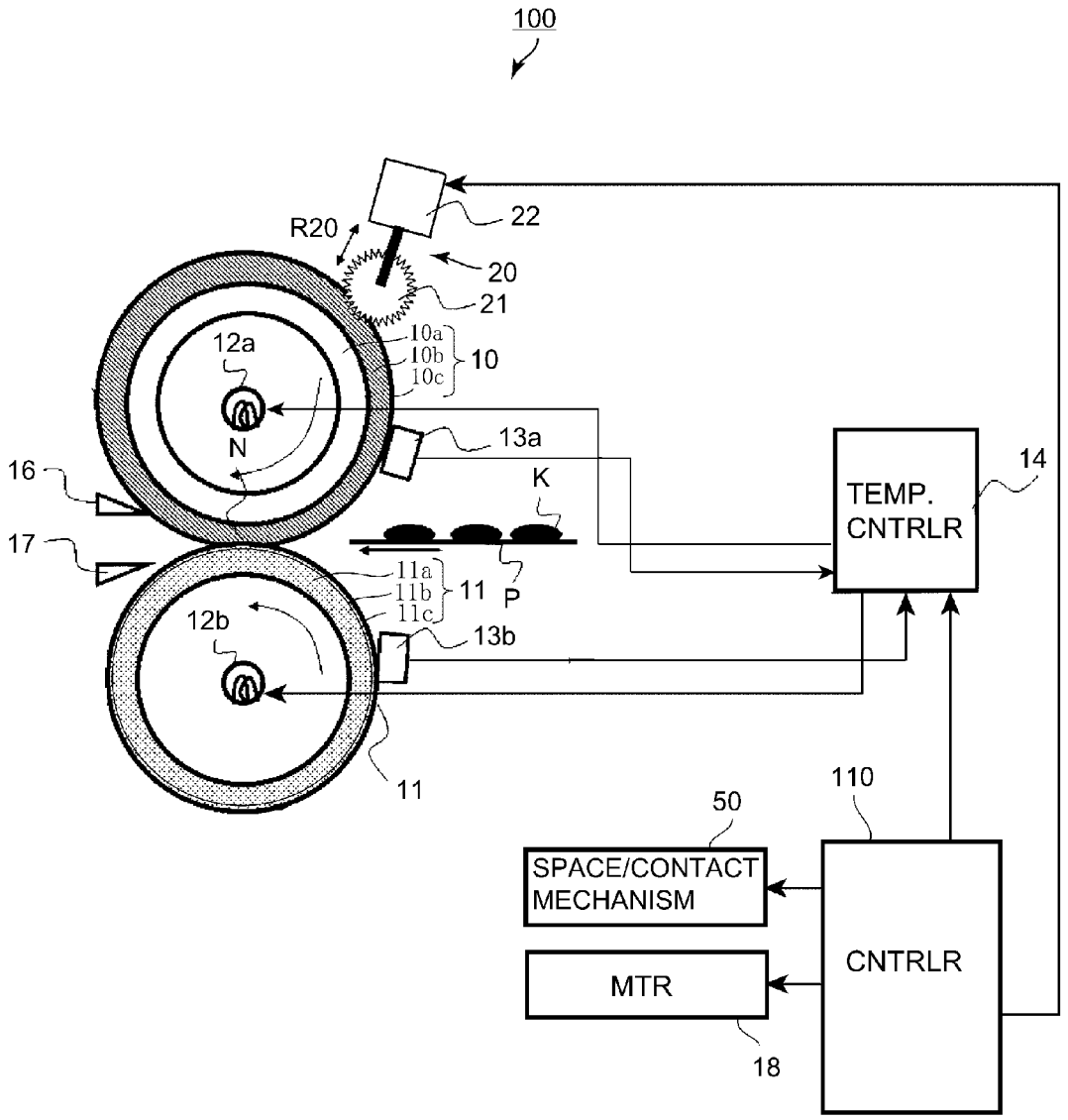
FIG. 6 is a schematic sectional view of the fixing device in the fifth embodiment, and shows the general structure of the device.

FIG. 6 is a schematic sectional view of the fixing device in the fifth embodiment, and shows the general structure of the device. Referring to FIG. 6, the fixing device in the fifth embodiment is virtually the same in structure and control as the one in the first embodiment shown in FIG. 2, except that it is not provided with the web-type cleaning device 40. Therefore, the components of the fixing device in this embodiment, shown in FIG. 6, which are the same in structure and function as the counterparts in the first embodiment, are given the same referential codes as those given to the counterparts, and are not going to be described here in order not to repeat the same descriptions.

Referring to FIG. 6, even in the case of a fixing device which does not have the web-type cleaning device 40, the toner having adhered to the fixation roller 10 is removed from the fixation roller 10; it is transferred onto the pressure roller 11 by the difference in temperature between the two rollers 10 and 11. That is, in practical terms, even if a fixing device does not have the web-type cleaning device 40, the fixation roller 10 can be cleaned before the fixing device 100 is operated in the buffing mode.

In the fifth embodiment, the fixation roller 10 is cleaned by the pressure roller 11; the offset toner on the fixation roller 10 is made to transfer onto the pressure roller 11 by the difference in temperature between the two rollers 10 and 11. Thus, in the cleaning mode, the temperatures of the fixation roller 10 and pressure roller 11 are set so that the amount of difference in temperature between the fixation roller 10 and pressure roller 11 becomes greater than in the operation for heating a sheet of the recording medium, in order to enhance the effect of the temperature difference between the two rollers. More specifically, in the cleaning mode, the surface temperature of the pressure roller 11 is set lower than in the mode for heating a sheet of the recording medium, whereas the surface temperature of the fixation roller 10 is set higher than in the mode for heating a sheet of the recording medium. Thus, in the cleaning mode, the pressure roller 11 is greater in its ability to remove the offset toner from the fixation roller 10 than in the mode for heating a sheet of the recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 029192/2012 filed Feb. 14, 2012 which is hereby incorporated by reference.

What is claimed is:

1. An image heating apparatus comprising:

a heating rotatable member configured to heat a toner image on a recording material, in a nip;

a nip forming member cooperating with said heating rotatable member to form the nip;

a rubbing rotatable member configured to rub a surface of the heating rotatable member;

a moving mechanism configured to move said rubbing rotatable member between a position spaced from said heating rotatable member and a position for rubbing said heating rotatable member; and a controller configured to execute, when the recording material is not passing through the nip, an operation in a first mode and continuously therewith an operation in a second mode, wherein in the first mode, said heating rotatable member is rotated at least through one full-turn in a state that said rubbing rotatable member is in the spaced position and that said heating rotatable member is in contact with said nip forming member with a target temperature of said heating rotatable member higher than a target temperature of said nip forming member, and in the second mode, said rubbing rotatable member contacts said heating rotatable member by said moving mechanism and rubs the surface of said heating rotatable member, wherein said controller causes a temperature difference in the first mode between the target temperature of said heating rotatable member and a target temperature of said nip forming member to be larger than the temperature difference when the toner image is heated by the nip, and wherein said controller raises the temperature of said heating rotatable member in a state that said heating rotatable member and said nip forming member are spaced from each other, before said at least one rotation, in the first mode.

2. An image heating apparatus comprising:

a heating rotatable member configured to heat a toner image on a recording material, in a nip;

a nip forming member cooperating with said heating rotatable member to form the nip;

a rubbing rotatable member configured to rub a surface of the heating rotatable member;

a moving mechanism configured to move said rubbing rotatable member between a position spaced from said heating rotatable member and a position for rubbing said heating rotatable member;

a controller configured to execute, when the recording material is not passing through the nip, an operation in a first mode and continuously therewith an operation in a second mode; and a cleaning member configured to clean the surface of said heating rotatable member, wherein said cleaning member includes a cleaning web, wherein in the first mode, said heating rotatable member is rotated at least through one full-turn in a state that said rubbing rotatable member is in the spaced position and that said heating rotatable member is in contact with said nip forming member with a target temperature of said heating rotatable member higher than a target temperature of said nip forming member, and in the second mode, said rubbing rotatable member contacts said heating rotatable member by said moving mechanism and rubs the surface of said heating rotatable member, wherein said controller causes a temperature difference in the first mode between the target temperature of said heating rotatable member and a target temperature of said nip forming member to be larger than the temperature difference when the toner image is heated by the nip, and wherein said controller causes an amount, per unit time, of winding-up of said web in the first mode to be larger than that when the toner image is heated by the nip.

3. An image heating apparatus comprising:

a heating rotatable member configured to heat a toner image on a recording material, in a nip;

a nip forming member cooperating with said heating rotatable member to form the nip;

a rubbing rotatable member configured to rub a surface of the heating rotatable member;

a moving mechanism configured to move said rubbing rotatable member between a position spaced from said heating rotatable member and a position for rubbing said heating rotatable member;

a controller configured to execute, when the recording material is not passing through the nip, an operation in a first mode operation and continuously therewith an operation in a second mode; and a cleaning member configured to clean the surface of said heating rotatable member, wherein said cleaning member includes a cleaning web, wherein in the first mode, said heating rotatable member is rotated at least through one full-turn in a state that said rubbing rotatable member is in the spaced position and that said heating rotatable member is in contact with said nip forming member with a target temperature of said heating rotatable member higher than a target temperature of said nip forming member, and in the second mode, said rubbing rotatable member contacts said heating rotatable member by said moving mechanism and rubs the surface of said heating rotatable member, wherein said controller causes a temperature difference in the first mode between the target temperature of said heating rotatable member and a target temperature of said nip forming member to be larger than the temperature difference when the toner image is heated by the nip, and wherein said controller causes a pressure of said web on said heating rotatable member in said first mode to be higher than that when the toner image is heated by the nip.

4. An image heating apparatus comprising:

first and second rotatable members configured to form a nip portion for heating a toner image on a sheet;

a rubbing rotatable member configured to rub an outer surface of said first rotatable member;

a cleaning member configured to clean said second rotatable member;

a moving mechanism configured to move said rubbing rotatable member between a contact position where said rubbing rotatable member contacts said first rotatable member and an spaced position where said rubbing rotatable member is spaced from said first rotatable member;

a counter configured to count the number of sheets passed through the nip portion; and a controller configured to execute a rubbing operation of said first rotatable member by moving said rubbing rotatable member from the spaced position to the contact position based on an output of said counter, wherein said controller executes a cleaning operation of said first rotatable member through said second rotatable member by said cleaning member during at least one rotation of said first rotatable member, before the rubbing operation is executed, based on the output of said counter.

5. An apparatus according to claim 4, wherein said cleaning member removes toner, on said second rotatable member, transferred from said first rotatable member in the cleaning operation.

6. An apparatus according to claim 5, wherein the temperature of said first rotatable member is higher than that of said second rotatable member in the cleaning operation.

* * * * *